US010961829B2

(12) United States Patent
Nowitzki et al.

(10) Patent No.: US 10,961,829 B2
(45) Date of Patent: Mar. 30, 2021

(54) FALLBACK BEARING PROTECTION SYSTEM

(71) Applicant: Halliburton Energy Services, Inc., Houston, TX (US)

(72) Inventors: Wesley John Nowitzki, Tulsa, OK (US); Jason Eugene Hill, Bristow, OK (US); Thomas Gottschalk, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 57 days.

(21) Appl. No.: 16/425,659

(22) Filed: May 29, 2019

(65) Prior Publication Data

US 2020/0263697 A1 Aug. 20, 2020

Related U.S. Application Data

(60) Provisional application No. 62/805,805, filed on Feb. 14, 2019.

(51) Int. Cl.
*E21B 43/12* (2006.01)
*F04D 13/10* (2006.01)
(Continued)

(52) U.S. Cl.
CPC ..... *E21B 43/128* (2013.01); *F04D 13/10* (2013.01); *F04D 29/046* (2013.01); *F04D 29/54* (2013.01);
(Continued)

(58) Field of Classification Search
CPC ... E21B 43/128; F04D 13/10; F05D 2260/607
See application file for complete search history.

(56) References Cited

U.S. PATENT DOCUMENTS 6,033,567 A * 3/2000 Lee ..... B01D 17/0217 166/265
6,308,780 B1 * 10/2001 Efimkin ..... E21B 21/00 166/311
(Continued)

FOREIGN PATENT DOCUMENTS

EP 2464883 B1 10/2018
GB 2376250 A * 12/2002 ..... F04D 13/12
KR 10-2017-0022630 A 3/2017

OTHER PUBLICATIONS

International Search Report and Written Opinion dated Apr. 16, 2020, International PCT Application No. PCT/US2019/066872.

*Primary Examiner* — Ninh H. Nguyen
*Assistant Examiner* — Brian Christopher Delrue
(74) *Attorney, Agent, or Firm* — McGuireWoods LLP

(57) ABSTRACT

An electrical submersible pump comprising a fallback bearing protection system, the system comprising: locking member; boot pivotally connected to shaft of electrical submersible pump adjacent to locking member, wherein the boot comprises a sloped outer wall capable of forming a fluid boundary thereby diverting fallback fluid away from uppermost bearing of electrical submersible pump; ridge disposed on the sloped outer wall of the boot. A method for protecting uppermost bearings of electrical submersible pump, the method comprising: operating the electrical submersible pump; removing power supply from electrical submersible pump; allowing fallback fluid to flow from a tubing disposed above electrical submersible pump into the electrical submersible pump thereby rotating fallback bearing protection system pivotally connected to shaft within electrical submersible pump; allowing the rotating fallback bearing protection system to create a fluid boundary capable of radially diverting the fallback fluid away from uppermost bearings of the electrical submersible pump.

20 Claims, 8 Drawing Sheets

(51) Int. Cl.
*F04D 29/046* (2006.01)
*F04D 29/54* (2006.01)

(52) U.S. Cl.
CPC .... *F05D 2240/50* (2013.01); *F05D 2260/607* (2013.01)

(56) References Cited

U.S. PATENT DOCUMENTS 7,182,584 B2 * 2/2007 Du ..... E21B 4/003 417/414
8,910,718 B2 * 12/2014 Watson ..... E21B 43/128 166/378
10,253,883 B2 * 4/2019 Collins ..... E21B 4/003
2003/0132003 A1 * 7/2003 Arauz ..... F04D 13/10 166/370
2005/0087343 A1 * 4/2005 Du ..... F04D 13/021 166/369
2007/0277969 A1 * 12/2007 Hall ..... F04D 29/106 166/105
2009/0202371 A1 * 8/2009 Green ..... F04C 15/0073 417/423.3
2013/0068455 A1 * 3/2013 Brown ..... E21B 43/128 166/265
2013/0272898 A1 * 10/2013 Toh ..... F04D 13/10 417/44.1
2016/0201685 A1 * 7/2016 Becker ..... F04D 13/08 384/517
2017/0170702 A1 * 6/2017 Scholz ..... F01D 15/10
2017/0204904 A1 * 7/2017 Parmeter ..... F16C 23/043
2018/0080501 A1 * 3/2018 Falaschi ..... F16C 35/00
2018/0149173 A1 * 5/2018 Head ..... F04C 13/008
2018/0171767 A1 * 6/2018 Huynh ..... H02K 7/14
2018/0179861 A1 * 6/2018 Artinian ..... F04D 27/0261
2018/0179868 A1 * 6/2018 Andonian ..... E21B 43/128
2018/0179870 A1 * 6/2018 Artinian ..... E21B 43/122
2018/0179871 A1 * 6/2018 Artinian ..... E21B 43/128
2018/0179872 A1 * 6/2018 Filatov ..... E21B 43/16
2018/0179873 A1 * 6/2018 Artinian ..... F04D 29/5806
2018/0347305 A1 * 12/2018 Angers, Jr. ..... E21B 33/04
2020/0141223 A1 * 5/2020 Brown ..... E21B 43/121
2020/0340481 A1 * 10/2020 Martinez ..... F04D 1/06

* cited by examiner

FALLBACK BEARING PROTECTION SYSTEM

CROSS-REFERENCE TO RELATED APPLICATIONS

This application claims the benefit of and priority to U.S. Provisional Application No. 62/805,805, filed Feb. 14, 2019, which is hereby incorporated by reference.

BACKGROUND

Many oil and gas production wells are eventually transitioned over to secondary lift techniques as their production rates decline. That is, their bottom hole pressures are no longer high enough to efficiently drive the produced fluids out of the wellbore. Secondary lift techniques may include installation of pumping equipment into the wellbore to increase pressure and/or lift fluids out of the wellbore. Suitable pumping equipment may include sucker rod/pump lift system, plunger lift system, and electrical submersible pump (ESP) system, among others.

When an electrical submersible pump system is shut down or turned off, deliberately or otherwise, the solids that have passed through the pump and that are trapped in the tubing can fallback into the pump. Solids in this case may refer to any solid particulate that may be entrained in the well fluid. The solids or abrasives can fill the running clearances of the hardened bearings especially of the top most pump in an Electrical submersible pump system. There may be a bearing at the top of every pump known as the discharge head. The discharge head of the top pump and its bearing may be exposed to the highest concentration of solids. This high concentration of solids may fill the running clearances and cause the Electrical submersible pump system to have hard starts and in severe cases the shaft may break leading to low production. This low production scenario often results in an operator pulling the well and replacing the pumps in an Electrical submersible pump system.

BRIEF DESCRIPTION OF THE DRAWINGS

These drawings illustrate certain aspects of some of the present disclosure, and should not be used to limit or define the disclosure.

DETAILED DESCRIPTION

The present disclosure is directed to oil and gas production wells, and, at least in part, to using a fallback bearing protection system thereby preventing solids from filling running clearances of a top bearing in an electrically submersible pump. In an embodiment the fallback bearing protection system may act as not only a cover, but may also divert fallback fluids away from the running clearances. In an embodiment, the fallback bearing protection system may comprise a locking member and a boot. The fallback bearing protection system may comprise any suitable material. In an embodiment, the locking member and the boot may comprise different materials. Optionally, the locking member and the boot may comprise the same materials. The fallback bearing protection system of the present disclosure may be used in any suitable operation, system, or method. While the present disclosure depicts systems and methods of a fallback bearing system in an artificial lift system, it should be noted that the fallback bearing protection system may be used in a wide variety of applications and should not be limited herein. The fallback bearing protection system may be described in more detail below.

Figure 1:
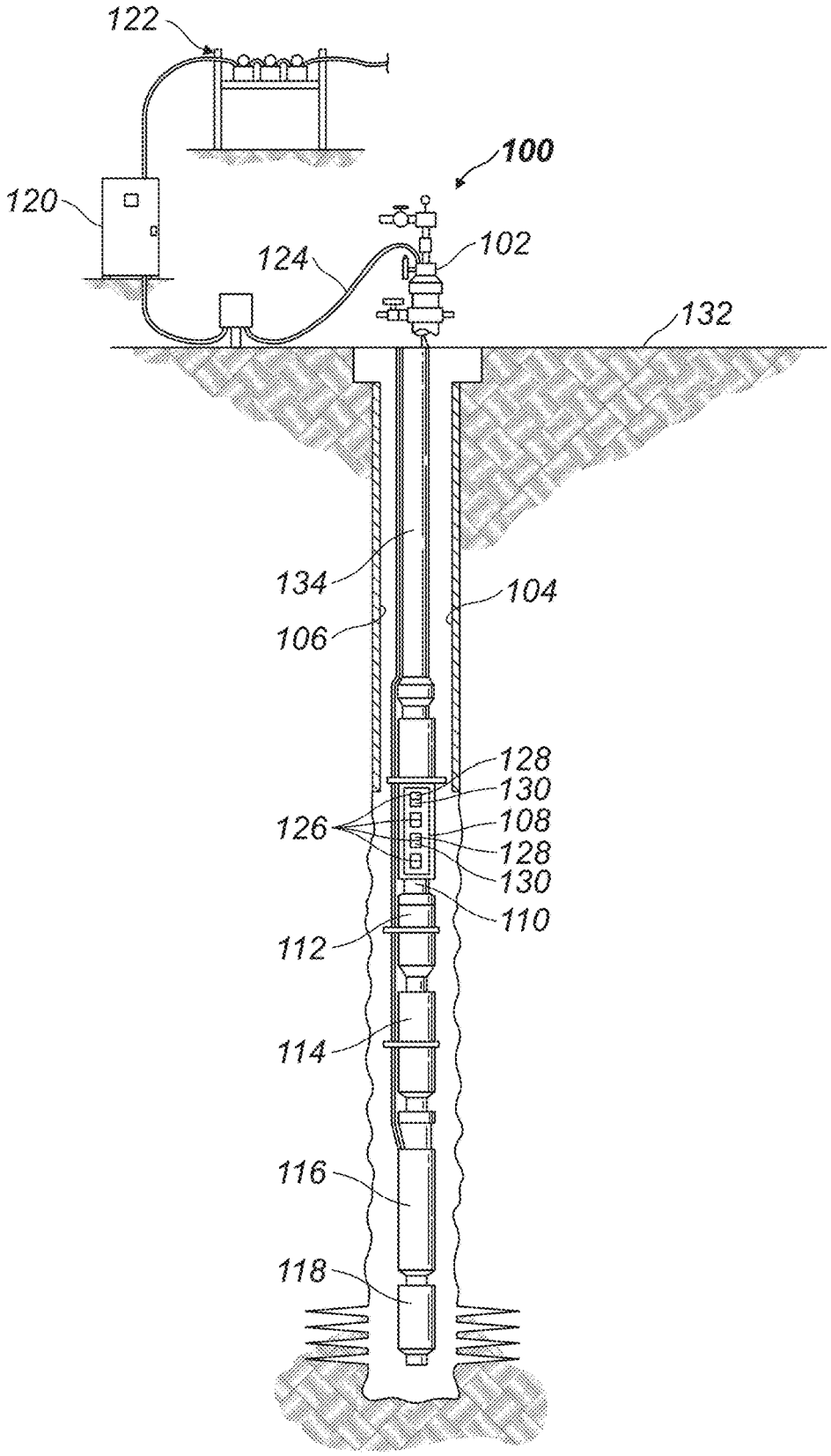
FIG. 1 is a schematic illustration an electrical submersible pump system disposed within a wellbore.

FIG. 1 is an example of electrical submersible pump system 100. Any suitable electrical submersible pump system 100 and or configuration may be used. The electrical submersible pump system 100 may include wellbore 104 having a wellhead 102 at the surface 132. Wellbore 104 may extend and penetrate various earth strata including hydrocarbon-containing formations. Casing 106 may be cemented along a length of wellbore 104. A power source 122 may comprise an electrical cable 124, or multiple electrical cables, extending into the wellbore 104 and coupled with motor 116. It should be noted, that while FIG. 1 generally depicts a land-based operations, those skilled in the art will readily recognize that the principles described herein are equally applicable to subsea operations that employ floating or sea-based platforms and rigs, without departing from the scope of the disclosure.

An electrical submersible pump system 100 may include a multistage centrifugal pump. In an embodiment, the stages 126 may be stacked. Each stage 126 may include a rotating impeller 130 and a stationary diffuser 128. Any suitable rotating impeller 130 and stationary diffuser 128 may be used. Produced fluid may mix with the treatment fluid in the wellbore. In an embodiment, the mixture may also comprise solids. Any solid may be found in the mixture and should not be limited to the examples herein. Intake 112 may allow fluid to enter the bottom of electrical submersible pump 108 and flow to the first stage 126 of the electrical submersible pump 108. The mixture may flow into the first stage 126 and pass through an impeller 130. The mixture may then be centrifuged radially outward thereby gaining energy in the form of velocity. The centrifugal pump may be driven by any suitable motor 116. In an embodiment, the centrifugal pump may be driven by an induction motor. The mixture may then pass through the impeller 130 and enter the diffuser 128. Any suitable diffuser 128 may be used. The mixture may pass through several stages 126 similar to this one, resulting in a higher pressure after each step. In an embodiment, the fluid may pass through a final stage 126 through the discharge head (not shown) of the electrical submersible pump 108, through a tubing 134 and to the surface 102 of the wellbore 104.

In an embodiment, the electrical submersible pump system 100 may be shutdown and/or turned off. Fluid that may have passed through the electrical submersible pump 108 may remain in tubing 134 above the electrical submersible pump 108 upon shutdown and/or turnoff of the electrical submersible pump system 100. The fluid trapped within tubing 134 above the electrical submersible pump 108 and may flow back down tubing 134 and into discharge head (referring to FIG. 2) of the electrical submersible pump 108. This fluid may be referred to herein as "fallback fluid." Any suitable fluid may be considered fallback fluid and should not be limited to the embodiments herein. The fallback fluid may comprise potential energy as it sits in the tubing 134. Once the fallback fluid flows back into electrical submersible pump 108, the potential energy of the fallback fluid may be converted to kinetic energy, which may in turn rotate shaft 110 of the electrical submersible pump system 100. In an embodiment, fallback fluid may cause shaft 110 to rotate in an opposite direction from when the system was powered on and operating normally.

Figure 2:
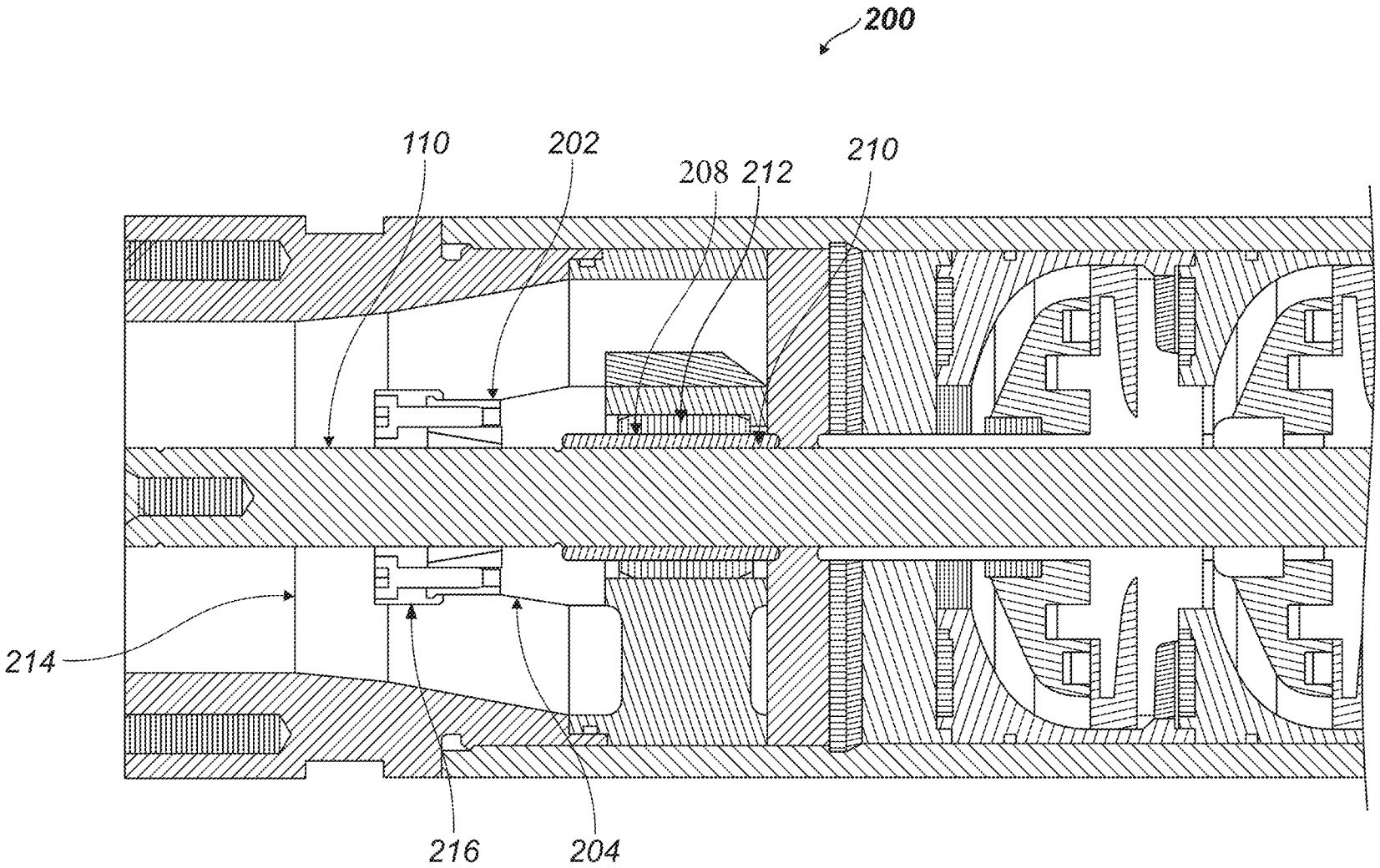
FIG. 2 illustrates a cross-sectional view of fallback bearing protection system disposed within an electrical submersible pump.

In an embodiment, the electrical submersible pump 108 may comprise a fallback bearing protection system (referring to FIG. 2) that may divert fallback fluid away from top bearings (referring to FIG. 2). The centrifugal pump may be powered by any suitable motor 116. In an embodiment, the centrifugal pump may be powered by a downhole submersible motor 116 such as, but not limiting to, an electric motor, the like, and/or any combination thereof. Located between the pump intake 112 and the motor 116 may be a seal section 114 that mitigates the axial thrust produced by the pump 108 and may provide a pressure balance between the motor internals and the downhole pressure. The power may be supplied to the motor 116 downhole via a specially constructed electric cable 124 that runs from the surface 132 down to the motor 116. A controller 120 may be located above the surface 102 to maintain a proper flow of electricity to the pump motor 116. Any suitable controller 120 may be used. In an embodiment, a treatment fluid may be injected into the system via the wellhead 102. The treatment fluid may flow through an annulus to the bottom of the wellbore 104 where it may then mix with the produced fluids. The mixture may then flow through each stage of the centrifugal pump. In an embodiment, electrical submersible pump system 100 may further comprise sensor 118. Sensor 118 may include one or more sensors used to monitor the operating parameters of electrical submersible pump 108 and/or conditions in wellbore 104, such as the intake pressure, casing annulus pressure, internal motor temperature, pump discharge pressure and temperature, downhole flow rate, equipment vibration, the like, and/or any combination thereof. It should be understood that the above description of the electrical submersible pump system 100 is merely an example and any suitable electrical submersible pump system 100 may be otherwise arranged as may be applicable for particular application.

FIG. 2 illustrates a cross-sectional view of fallback bearing protection system 202 disposed within an electrical submersible pump 200. Fallback bearing protection system may be disposed within discharge head 214 secured about shaft 110. Fallback bearing protection system 202 may be secured about shaft 110 in any suitable manner, including but not limited to, by means of compressional force, a fastener, an adhesive, a weld, by way of mechanically interlocking the components, the like, and/or any combination thereof. In an embodiment, fallback bearing protection system 202 may comprise locking member 216 and boot 204. Any suitable locking member 216 and boot 204 capable of diverting fallback fluid away from bearing 210 may be used. Components of fallback bearing protection system 202 may be discussed in detail in FIG. 3. In an embodiment, electrical submersible pump 200 may be shut down and/or turned off and the fallback fluid in tubing 134 (referring to FIG. 1) may flow back into electrical submersible pump 200. Shaft 110 comprising the fallback bearing protection system 202 may be rotated as fallback fluid flows there through. Fallback fluid may contact fallback bearing protection system 202 as shaft 110 may be rotating, thereby creating a fluid boundary condition, which may radially divert the fallback fluid away from channel 208 disposed between bearing 210 and bushing 212. As used herein, "fluid boundary condition" may refer to the fluid boundary created by the fallback fluid as it flows into electrical submersible pump 200 thereby contacting rotating boot (referring to FIG. 3). The thickness of the fluid boundary condition may be directly proportional to the rotational speed of the boot, viscosity of the fluid, fallback velocity of the fluid (laminar or turbulent), the like, and/or any combination thereof. The rotational speed of the boot may be directly proportional to the velocity of the fallback fluid as the potential energy changes to kinetic energy. In an embodiment, channel 208 may be a running clearance of a top bearing. Channel 208 may be of any suitable size and shape and should not be limited therein. In an embodiment, channel 208 may have a clearance of about 0.002 in (about 0.05 mm) to about 0.04 in (about 1 mm), or about 0.006 in (about 0.15 mm) to about 0.01 in (about 0.25 mm), or about 0.01 in (about 0.25 mm) to about 0.04 in (about 1 mm), or any value or range of values therein.

Figure 3:
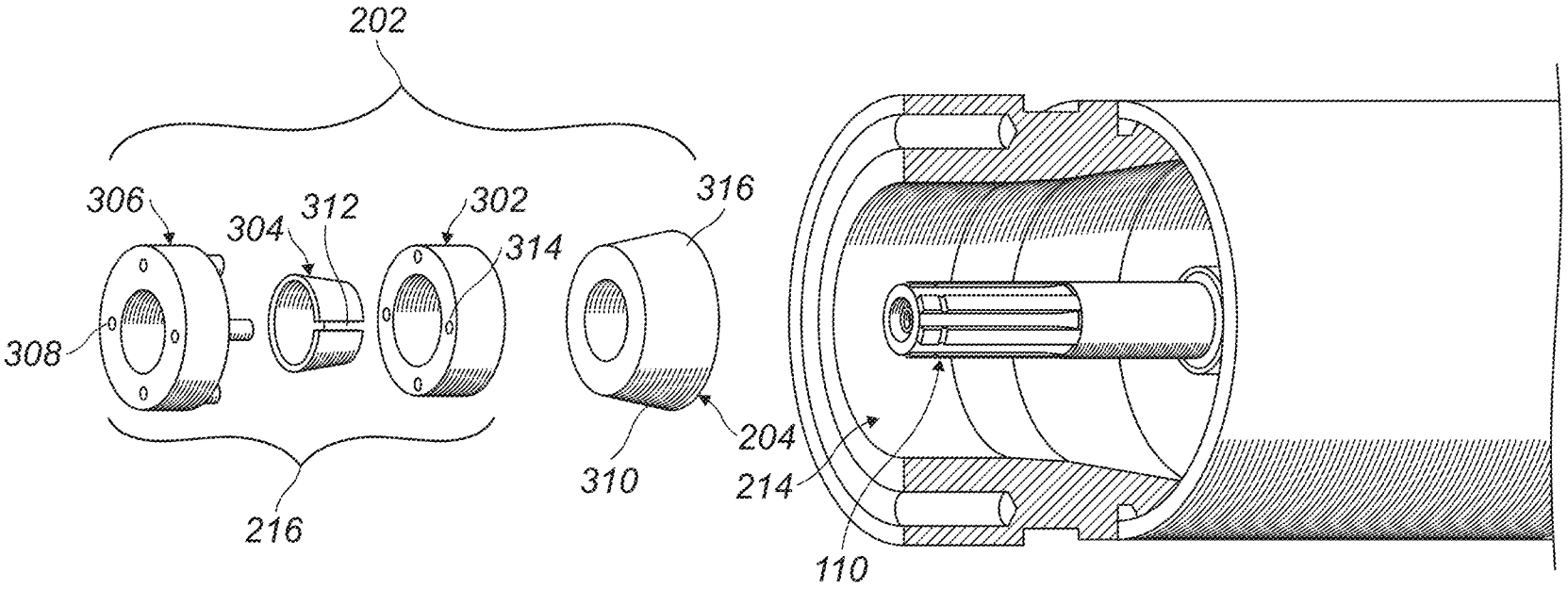
FIG. 3 illustrates components of a fallback bearing protection system.

FIG. 3 illustrates components of a fallback bearing protection system 202. In an embodiment, fallback bearing protection system 202 may comprise a locking member 216 and a boot 204. Any suitable locking member 216 capable of preventing boot 204 from dislodging from a shaft 110 may be used. In an embodiment, the locking member 216 may comprise a nut 302, a locking ring 304, a cap 306, and fasteners 308.

Locking member 216 may comprise any suitable material including, but not limited to, metal, metal alloys, the like, and/or any combination thereof. As used herein, the term "metal alloy" may refer to a mixture of two or more elements, wherein at least one of the elements is a metal. The other element(s) may be a non-metal or a different metal. In an embodiment, locking ring 304 may comprise at least one metal and/or metal alloy selected from the group consisting of lithium, sodium, potassium, rubidium, cesium, francium, beryllium, magnesium, calcium, strontium, barium, radium, aluminum, gallium, indium, tin, thallium, lead, bismuth, scandium, titanium, vanadium, chromium, manganese, iron, cobalt, nickel, copper, zinc, yttrium, zirconium, niobium, molybdenum, technetium, ruthenium, rhodium, palladium, silver, cadmium, lanthanum, hafnium, tantalum, tungsten, rhenium, osmium, iridium, platinum, gold, graphite, and/or combinations thereof. In an embodiment, the individual components of locking member 216 may comprise the same material and/or materials. Optionally, the individual components of locking member 216 may comprise different material and/or materials. In an embodiment, locking member 216 may comprise any suitable outer wall angle. As used herein, wall angle refers to the angle of the wall relative to a center axis of locking member 216. In an embodiment, mechanism 216 may comprise an outer wall angle of about 1° to about 89°, or about 8° to about 18°, or about 18° to about 38°, or about 38° to about 58°, or about 58° to about 78°, or about 78° to about 89°, or any value or values therein.

Locking member 216 may comprise a locking ring 304. Any suitable locking ring 304 may be used and should not be limited herein. In an embodiment, locking ring 304 may comprise any suitable diameter capable of being at least partially disposed within nut 302. In an embodiment, locking ring 304 may comprise a diameter of about 0.63 in (about 15 mm) to about 1.7 in (about 43 mm), or about 0.63 in (about 15 mm) to about 1.2 in (about 30 mm), or about 1.2 in (about 30 mm) to about 1.7 in (about 43 mm), or any value or range of values therein. Optionally, locking ring 304 may comprise gap 312 thereby providing a locking ring 304 comprising an adjustable diameter. Gap 312 may be any suitable size. In an embodiment, gap 312 may be any suitable shape and should not be limited to the embodiment disclosed herein. In an embodiment, locking ring 304 may have an adjustable diameter of about 0.01 in (about 0.025 mm) to about 0.06 in (about 1.5 mm), or about 0.01 in (about 0.025 mm) to about 0.03 in (about 0.75 mm), or about 0.03 in (about 0.75 mm) to about 0.06 in (about 1.5 mm), or any value or range of values therein. In an embodiment, locking ring 304 may comprise any suitable outer wall angle capable of at least partially disposing locking ring 304 within nut 302. As used herein, wall angle refers to the angle of the wall relative to a center axis. In an embodiment, locking ring 304 may comprise an outer wall angle of about 8° to about 18° or about 5° to about 11°, or about 11° to about 18°, or any value or values therein.

Locking member 216 may further comprise nut 302. In an embodiment, nut 302 may comprise any suitable size, shape, and diameter. In an embodiment, nut 302 may comprise an inner diameter of about 0.63 in (about 15 mm) to about 1.7 in (about 43 mm), or about 0.63 in (about 15 mm) to about 1.2 in (about 30 mm), or about 1.2 in (about 30 mm) to about 1.7 in (about 43 mm), or any value or range of values therein. In an embodiment, nut 302 may comprise an outer diameter of about 0.63 in (about 15 mm) to about 1.7 in (about 43 mm), or about 0.63 in (about 15 mm) to about 1.2 in (about 30 mm), or about 1.2 in (about 30 mm) to about 1.7 in (about 43 mm), or any value or range of values therein. In an embodiment, nut 302 may have a depth of about 0.25 in (about 6 mm) to about 2 in (about 50 mm), or about 0.25 in (about 6 mm) to about 1 in (about 25 mm), or about 1 in (about 25 mm) to about 2 in (about 50 mm), and/or any value or range of values therein. In an embodiment, the outer wall of nut 302 may be straight or slopped relative to the center axis of nut 302. In an embodiment, the outer wall of nut 302 may comprise any suitable wall angle relative to the center axis of nut 302. Nut 302 may have an outer wall angle of about 1° to about 25°, or about 1° to about 15°, or about 15° to about 25°, and/or any value or range of values therein. In an embodiment, nut 302 may also comprise ridge 310 and/or a plurality of ridges 310. Ridge 310 is discussed in greater detail below. In an embodiment, nut 302 may comprise an aperture 314. In an embodiment, nut 302 may comprise a plurality of apertures 314. Apertures 314 may be of any suitable size, shape, and depth capable of receiving a fastener 308 and should not be limited herein.

Locking member 216 may further comprise a cap 306. In an embodiment, cap 306 may be disposed on locking ring 304 which may be at least partially disposed within in nut 302. In an embodiment, about 10% to about 30% of cap 306 disposed on locking ring 304 may be disposed within nut 302. Cap 306 may comprise any suitable diameter, size, and shape. In an embodiment, cap 306 may comprise an inner diameter of about ⅝ in (about 15 mm) to about 27/16 in (about 42 mm), or about ⅝ in (about 15 mm) to about 18/16 in (about 28 mm), or about 18/16 in (about 28 mm) to about 27/16 in (about 42 mm), and/or any value or range of values therein. In an embodiment, cap 306 may comprise an outer diameter of about ⅝ in (about 15 mm) to about 27/16 in (about 42 mm), or about ⅝ in (about 15 mm) to about 18/16 in (about 28 mm), or about 18/16 in (about 28 mm) to about 27/16 in (about 42 mm), and/or any value or range of values therein. In an embodiment, cap 306 may have any suitable depth and should not be limited herein.

In an embodiment, cap 306 may comprise an aperture (not shown) and/or a plurality of apertures capable of receiving a fastener 308. Aperture and/or a plurality of apertures may be of any suitable size, shape, and depth. In an embodiment, aperture may extend axially through cap 306. Fastener 308 may be disposed within aperture, thereby extending axially through cap 306 and at least partially into nut 302, thereby holding locking member 216 together. Any suitable fastener 308 may be used. Fasteners 308 may connect cap 306, locking ring 304, and nut 302 together. Suitable fasteners 308 may include, but are not limited to, screws, the like, and/or any combination thereof.

In an embodiment, locking member 216 may be disposed on boot 204. Any suitable boot 204 capable of diverting fallback fluids away from a running clearance of a bearing may be used. Boot 204 may comprise any suitable material that may be non-metallic in nature. Suitable non-metallic materials may include, but are not limited to, elastomers, polymers, the like, and/or any combination thereof. In an embodiment, boot 204 may comprise at least one material selected from the group consisting of polyamides, polyimides, acetal copolymers, polybenzimidazoles, polyetheretherketones (PEEK), polyetherimides, nylons, polyesters, polysulphones, polyphenylenesulphones, polyphenylene sulphides, polymethylmethacralytes, polycarbonates, polyvinylchlorides (PVC), polyviylidenefluorides, polytetrafluoroethylenes (PTFE), polyethylenes, polypropylenes, glass epoxies, glass silicones, epoxy resins, phenol resins, polybenzoimidazole resins, benzoxazine resins, cyanate ester resins, unsaturated polyester resins, vinyl ester resins, urea resins, melamine resins, bismaleimide resins, polyimide resins and polyamideimide resins, polyolefin resins, styrene-based resins, polyoxymethylene resin, polyamide resins, polyurethane resins, polyurea resins, polydicyclopentadidene resin, polycarbonate resins, polymethylene methacrylate resin, polyetherimide resins, polysulfone resins, polyallylate resins, polyether sulfone resins, polyketone resins, polyether ketone resins, polyether ether ketone resins, polyether ketone ketone resins, polyarylate resins, polyether nitrile resins, polyimide resins, polyamideimide resins, phenol resins, phenoxy resins, fluorine-based resins such as polytetrafluoroethylene resin, elastomers (e.g., butadiene acrylonitrile, its carboxylic acid or amine modification products, fluoroelastomers, polysiloxane elastomers), rubbers (butadiene, styrene butadiene, styrene butadiene styrene, styrene isoprene styrene, natural rubber, etc.), resins for RIM (e.g., those containing a catalyst or the like capable of forming polyamide 6, polyamide 12, polyurethane, polyurea or polycicyclopentadiene), cyclic oligomers (those containing a catalyst or the like capable of forming a polycarbonate resin, polybutylene terephthalate resin, etc.), the copolymers and modification products thereof, resins or plastics obtained by blending two or more of the foregoing, the like, and/or any combination thereof.

In an embodiment, boot 204 may comprise an outer wall 316. Outer wall 316 may be sloped or straight. In an embodiment, outer wall 316 may be sloped at any suitable angle relative to the center axis of boot 204. In an embodiment, outer wall 316 may be sloped at an angle of about 1° to about 33° or about 5° to about 11°, or about 11° to about 18°, and/or any value or values therein. In an embodiment, outer wall 316 of boot 204 may comprise ridge 310. In an embodiment, outer wall 316 of boot 204 may comprise a plurality of ridges 310. Any suitable ridge 310 may be used. In an embodiment, ridge 310 may be of any suitable depth and width. In an embodiment ridge 310 may comprise a depth of about 0.01 in (about 0.25 mm) to about 0.5 in (about 13 mm), or about 0.01 in (about 0.25 mm) to about 0.25 in (about 6 mm), or about 0.25 in (about 6 mm) to about 0.5 in (about 13 mm), and/or any value or range of values therein.

Ridge 310 may comprise any suitable width including, but not limited to, about 0.03 in (about 0.75 mm) to about 0.1 in (about 2.5 mm), or about 0.03 in (about 0.75 mm) to about 0.07 (about 1.8 mm), or about 0.07 (about 1.8 mm) to about 0.1 in (about 2.5 mm), and/or any value or range of values therein.

Each ridge 310 may comprise an outer diameter and an inner diameter. Outer diameter and inner diameter may be any suitable size and should not be limited herein. In an embodiment, outer diameter of each ridge 310 may be different. The outer diameter of ridge 310 closest to nut 302 may be smaller than outer diameter of ridge 310 closest to bushing 212 (referring to FIG. 2). Suitable outer diameters of ridge 310 may include, but are not limited to, ⅝ in (about 15 mm) to about 27/16 in (about 42 mm), or about ⅝ in (about 15 mm) to about 18/16 in (about 28 mm), or about 18/16 in (about 28 mm) to about 27/16 in (about 42 mm), and/or any value or range of values therein. Ridge 310 may comprise a plurality of ridges 310 between the two ridges 310 located at each respective end of boot 204, wherein the plurality of ridges 310 may gradually increase in diameter, thereby producing an overall sloped outer wall 316 with any suitable angle for a given application. In an embodiment, ridge 310 closest to bushing 212 (referring to FIG. 2) may comprise an outer diameter slightly greater than the inner diameter of channel 208 (referring to FIG. 2), thereby blocking opening of channel 208 from fallback fluid. Optionally, the outer diameter of each ridge 310 may be the same. Any suitable ridge 310 outer diameter capable of diverting fallback fluid away from a running clearance of a bearing may be used. In an embodiment, ridges 310 may be uniformly distributed along the boot 204. In an embodiment, ridges 310 may be non-uniformly distributed throughout the boot 204.

Figure 4A:
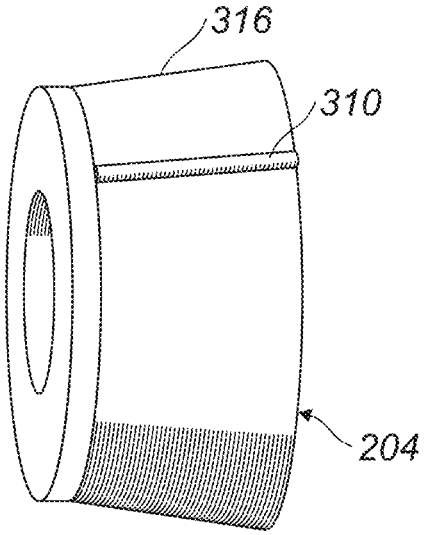
FIGS. 4A, 4B, and 4C illustrate an embodiment of a boot comprising a ridge.
Figure 4B:
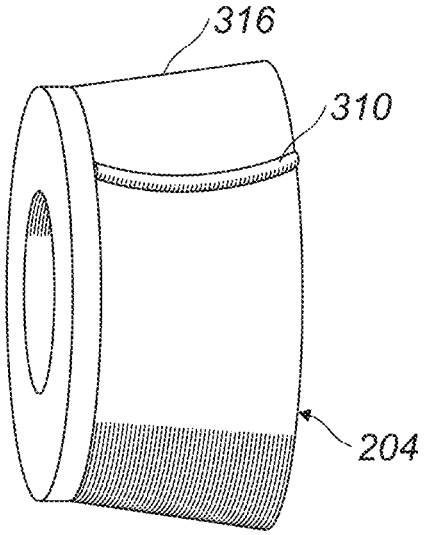
Figure 4C:
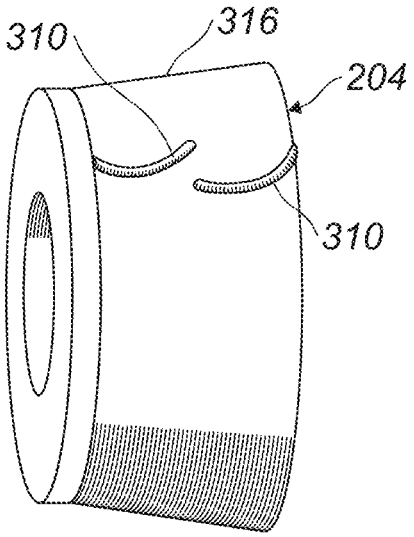

Ridge 310 may extend vertically and/or horizontally across boot 204. In an embodiment, ridge 310 may comprise any suitable shape including, but not limited to, rectangular, crescent, oval, the like, and/or any combinations thereof. FIGS. 4A and 4B illustrate an embodiment of boot 204 comprising a ridge 310, wherein the shape of ridge 310 is different for each embodiment. In an embodiment, ridge 310 may be truncated as shown in FIG. 4C. As used herein, "truncated" may refer to a plurality of ridges 310 wherein a first ridge 310 may comprise a first length and a second ridge 310 may comprise a second length, wherein the second length may be greater than the first length. This variable ridge 310 length may be repeated radially around boot 310.

In an embodiment, fallback bearing protection system may be offset from the center axis of the shaft thereby providing a different shape of the fallback bearing protection system which in turn may also provide additional protection and covering. Fallback bearing protection system may be configured in any suitable manner in a given system for a particular operation and should not be limited to the embodiments disclosed herein.

The fluids disclosed herein may directly or indirectly affect one or more components or pieces of equipment associated with the preparation, delivery, recapture, recycling, reuse, and/or disposal of the treatment fluid particulates. For example, the treatment fluid particulates may directly or indirectly affect one or more mixers, related mixing equipment, mud pits, storage facilities or units, composition separators, heat exchangers, sensors, gauges, pumps, compressors, and the like used to generate, store, monitor, regulate, and/or recondition the sealant composition. The treatment fluid particulates may also directly or indirectly affect any transport or delivery equipment used to convey the treatment fluid particulates to a well site or downhole such as, for example, any transport vessels, conduits, pipelines, trucks, tubulars, and/or pipes used to compositionally move the treatment fluid particulates from one location to another, any pumps, compressors, or motors (e.g., topside or downhole) used to drive the treatment fluid particulates into motion, any valves or related joints used to regulate the pressure or flow rate of the treatment fluid particulates (or fluids containing the same treatment fluid particulates), and any sensors (i.e., pressure and temperature), gauges, and/or combinations thereof, and the like. The disclosed treatment fluid particulates may also directly or indirectly affect the various downhole equipment and tools that may come into contact with the treatment fluid particulates such as, but not limited to, wellbore casing, wellbore liner, completion string, insert strings, drill string, coiled tubing, slickline, wireline, drill pipe, drill collars, mud motors, downhole motors and/or pumps, cement pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like.

Accordingly, this disclosure describes methods, systems, and apparatuses that may use the disclosed fall back bearing protection system. The methods, systems, and apparatuses may include any of the following statements:

Statement 1: An electrical submersible pump comprising a fallback bearing protection system, the system comprising: a locking member disposed on a shaft of the electrical submersible pump; a boot pivotally connected the shaft of the electrical submersible pump adjacent to the locking member, wherein the boot comprises a sloped outer wall capable of forming a fluid boundary thereby diverting a fallback fluid away from a uppermost bearing of the electrical submersible pump; and a ridge disposed on the sloped outer wall of the boot.

Statement 2. The system of statement 1, wherein the sloped outer wall of the boot comprises an outer wall angle of about 1° to about 33°.

Statement 3. The system of statement 1 or 2, wherein the ridge comprises at least one shape selected from the group consisting of rectangle, square, triangle, diamond, crescent, oval, circle, semi-circle, or any combination thereof.

Statement 4. The system of any of the preceding statements, wherein the ridge is disposed longitudinally across the outer wall of the boot.

Statement 5. The system of any of the preceding statements, wherein the sloped outer wall of the boot comprises a plurality of ridges.

Statement 6. The system of any of the preceding statements, wherein each ridge is distributed radially about the outer wall of the boot.

Statement 7. The system of any of the preceding statements, wherein each ridge is uniformly distributed radially about the outer wall of the boot.

Statement 8. The system of any of the preceding statements, wherein the plurality of ridges are truncated.

Statement 9. The method of any of the preceding statements, wherein a first ridge comprises a first length and a second ridge comprises a second length, wherein the first length is greater than the second length.

Statement 10. The system of any of the preceding statements, wherein the fluid boundary is directly proportional to at least one parameter selected from the group consisting of a rotational speed of the boot, viscosity of the fallback fluid, velocity of the fallback fluid, or any combination thereof.

Statement 11. The system of any of the preceding statements, wherein the rotational speed of the boot is directly proportional to the velocity of the fallback fluid as the potential energy is converted to kinetic energy.

Statement 12. The system of any of the preceding statements, wherein the fallback bearing protection system is offset from the center axis of the shaft thereby creating a different fluid boundary about the fallback bearing protection system.

Statement 13. The system of any of the preceding statements, wherein the boot comprises at least one material selected from the group consisting of an elastomer, a polymer, or any combination thereof.

Statement 14. The system of any of the preceding statements, wherein the locking member further comprises: a nut disposed on the shaft of the electrical submersible pump adjacent to the boot; a locking ring disposed at least partially within the nut; a cap disposed adjacent to the locking ring; and a fastener extending axially through the cap and at least partially through the nut.

Statement 15. The system of any of the preceding statements, wherein the locking member comprises at least one material selected from the group consisting of a metal, a metal alloy, or any combination thereof.

Statement 16. A method for protecting uppermost bearings of an electrical submersible pump, the method comprising: operating the electrical submersible pump; removing a power supply from the electrical submersible pump; allowing a fallback fluid to flow from a tubing disposed above the electrical submersible pump and into the electrical submersible pump thereby rotating a fallback bearing protection system pivotally connected to a shaft within the electrical submersible pump; allowing the rotating fallback bearing protection system to create a fluid boundary capable of radially diverting the fallback fluid away from the uppermost bearings of the electrical submersible pump.

Statement 17. The method of statement 16, wherein the fluid boundary is directly proportional to at least one parameter selected from the group consisting of a rotational speed of the boot, viscosity of the fallback fluid, velocity of the fallback fluid, or any combination thereof.

Statement 18. The method of statement 16 or 17, wherein the rotational speed of the boot is directly proportional to the velocity of the fallback fluid as the potential energy is converted to kinetic energy.

Statement 19. The method of any of statements 16 to 18, wherein the fallback bearing protection system is offset from the center axis of the shaft thereby creating a different fluid boundary about the fallback bearing protection system.

Statement 20. The method of any of statements 16 to 19, wherein the fallback bearing protection system radially diverts solids away from the uppermost bearing of an electrical submersible pump.

To facilitate a better understanding of the present disclosure, the following examples of certain aspects of some of the systems and methods are given. In no way should the following examples be read to limit, or define, the entire scope of the disclosure.

Example 1

Figure 5A:
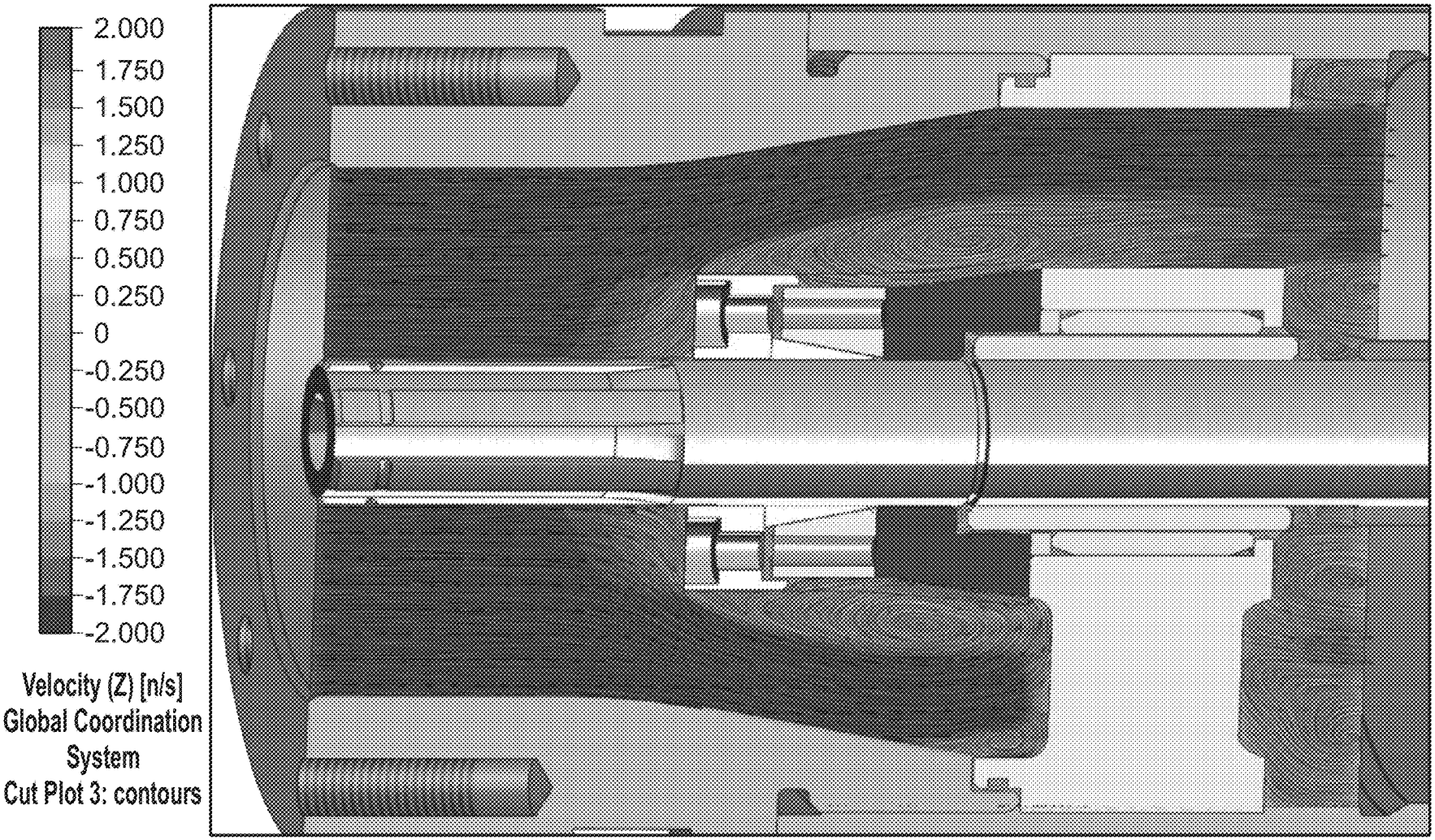
FIGS. 5A, 5B, 6A, and 6B illustrate models simulating the computational fluid dynamics of a fallback bearing protection system.
Figure 5B:
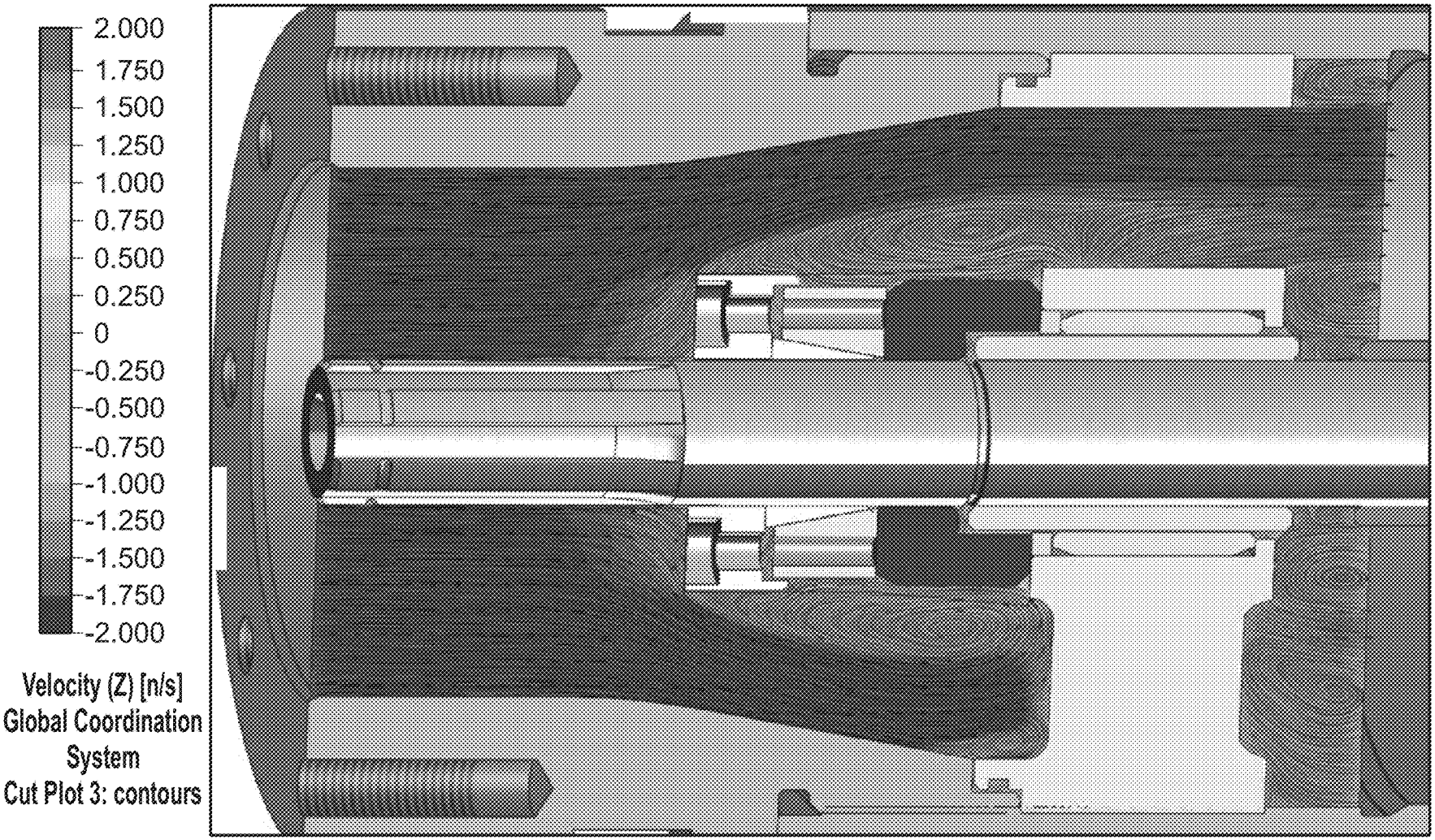
Figure 6A:
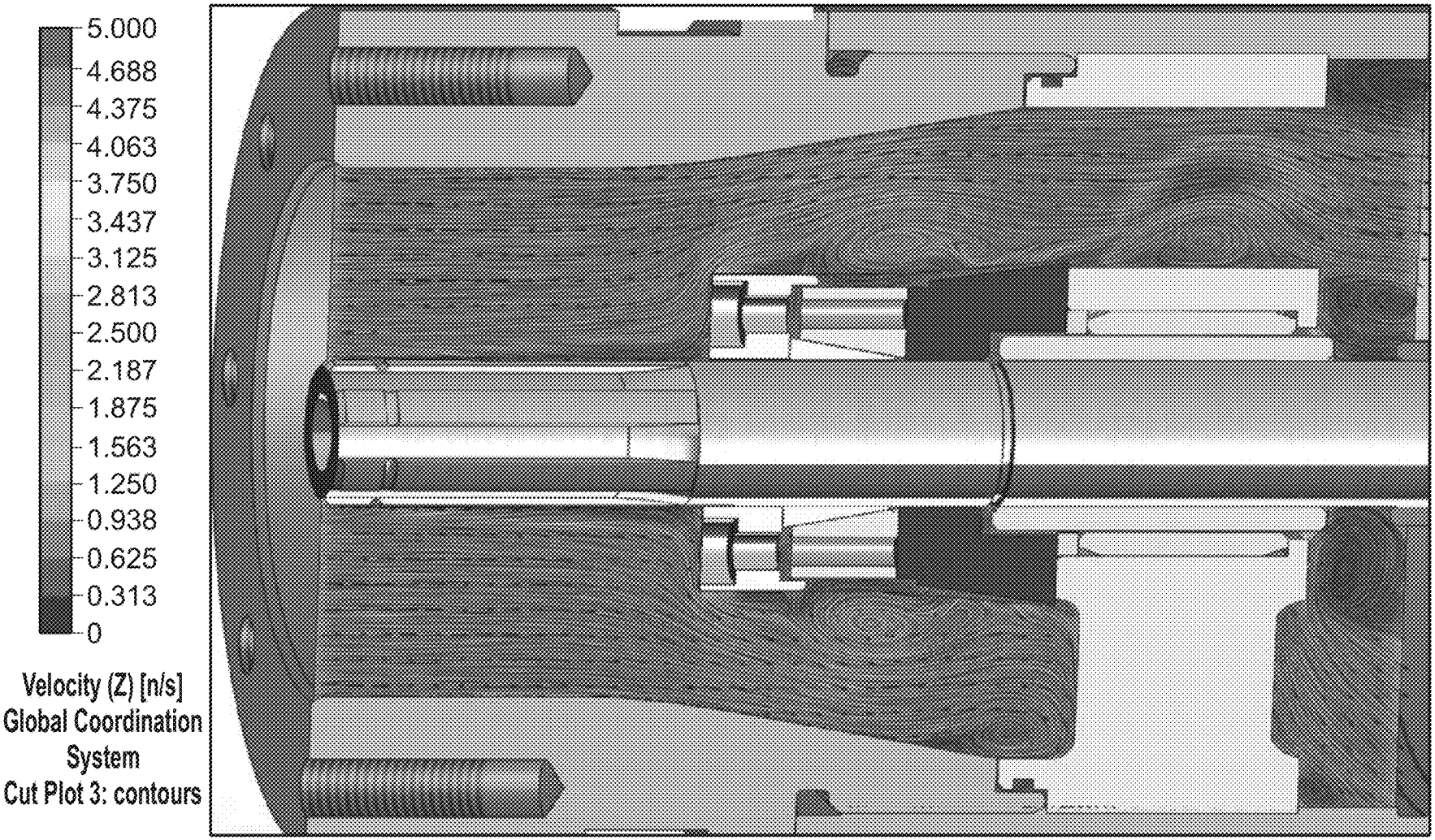
Figure 6B:
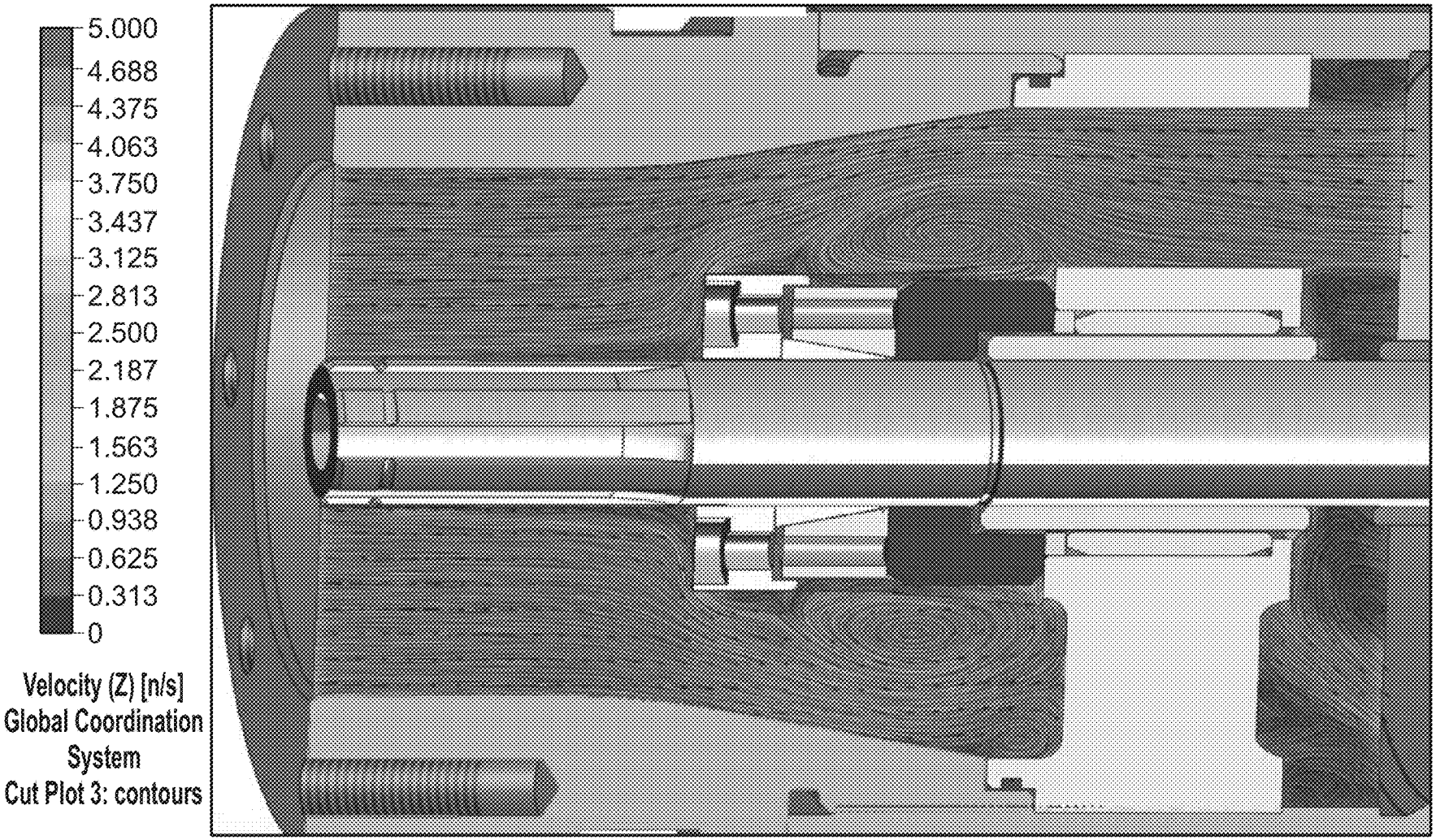

FIGS. 5A, 5B, 6A, and 6B illustrate models demonstrating the computational fluid dynamics of a fallback bearing protection system comprising a boot that may comprise a sloped outer wall compared to a boot comprising a boot with a straight wall. These models were created by simulating a fluid flow of about 300 barrels per day (bpd) to about 1,500 bpd. The fluid was assumed to have a specific gravity and viscosity similar to the specific gravity and viscosity of water. The systems were simulated to rotate at speeds of about 500 revolutions per minute (rpms) to about 3,600 rpms. These models may compare the fallback bearing protection system of the present disclosure to a system that may comprise a straight wall, no ridge boot. FIGS. 5A and 6A, which comprise the fallback bearing protection system of the present disclosure, transfers the fluid separation zone and resulting eddies downstream of the uppermost bearing/bushing entrance interface making it more difficult for entrained solids in the fallback fluid to enter therein than the straight walled boot shown in FIGS. 5B and 6B. The embodiments of 5A and 6A will better protect the uppermost bearings of an electrical submersible pump from fallback fluid when compared to FIGS. 5B and 6B. It should be noted that the models of FIG. 5A-6B are merely an example and the present disclosure should not be limited herein.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present disclosure is well adapted to attain the ends and advantages mentioned as well as those that are inherent therein. The particular examples disclosed above are illustrative only, as the present disclosure may be modified and practiced in different but equivalent manners apparent to those skilled in the art having the benefit of the teachings herein. Although individual examples are discussed, the disclosure covers all combinations of all those examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

What is claimed is:

1. An electrical submersible pump comprising a fallback bearing protection system, the system comprising:

a locking member disposed on a shaft of the electrical submersible pump;

a boot pivotally connected the shaft of the electrical submersible pump adjacent to the locking member, wherein the boot comprises a sloped outer wall capable of forming a fluid boundary thereby diverting a fallback fluid away from a uppermost bearing of the electrical submersible pump; and a ridge disposed on the sloped outer wall of the boot.

2. The system of claim 1, wherein the sloped outer wall of the boot comprises an outer wall angle of about 1° to about 33°.

3. The system of claim 1, wherein the ridge comprises at least one shape selected from the group consisting of rectangle, square, triangle, diamond, crescent, oval, circle, semicircle, or any combination thereof.

4. The system of claim 1, wherein the ridge is disposed longitudinally across the outer wall of the boot.

5. The system of claim 1, wherein the sloped outer wall of the boot comprises a plurality of ridges.

6. The system of claim 5, wherein each ridge is distributed radially about the outer wall of the boot.

7. The system of claim 5, wherein each ridge is uniformly distributed radially about the outer wall of the boot.

8. The system of claim 5, wherein the plurality of ridges are truncated.

9. The method of claim 8, wherein a first ridge comprises a first length and a second ridge comprises a second length, wherein the first length is greater than the second length.

10. The system of claim 1, wherein the fluid boundary is directly proportional to at least one parameter selected from the group consisting of a rotational speed of the boot, viscosity of the fallback fluid, velocity of the fallback fluid, or any combination thereof.

11. The system of claim 10, wherein the rotational speed of the boot is directly proportional to the velocity of the fallback fluid as the potential energy is converted to kinetic energy.

12. The system of claim 1, wherein the fallback bearing protection system is offset from the center axis of the shaft thereby creating a different fluid boundary about the fallback bearing protection system.

13. The system of claim 1, wherein the boot comprises at least one material selected from the group consisting of an elastomer, a polymer, or any combination thereof.

14. The system of claim 1, wherein the locking member further comprises:

a nut disposed on the shaft of the electrical submersible pump adjacent to the boot;

a locking ring disposed at least partially within the nut;

a cap disposed adjacent to the locking ring; and a fastener extending axially through the cap and at least partially through the nut.

15. The system of claim 14, wherein the locking member comprises at least one material selected from the group consisting of a metal, a metal alloy, or any combination thereof.

16. A method of using the system of claim 1 for protecting uppermost bearings of an electrical submersible pump, the method comprising:

operating the electrical submersible pump;

removing a power supply from the electrical submersible pump;

allowing a fallback fluid to flow from a tubing disposed above the electrical submersible pump and into the electrical submersible pump thereby rotating the fallback bearing protection system pivotally connected to a shaft within the electrical submersible pump;

allowing the rotating fallback bearing protection system to create a fluid boundary capable of radially diverting the fallback fluid away from the uppermost bearings of the electrical submersible pump.

17. The method of claim 16, wherein the fluid boundary is directly proportional to at least one parameter selected from the group consisting of a rotational speed of the boot, viscosity of the fallback fluid, velocity of the fallback fluid, or any combination thereof.

18. The method of claim 17, wherein the rotational speed of the boot is directly proportional to the velocity of the fallback fluid as the potential energy is converted to kinetic energy.

19. The method of claim 16, wherein the fallback bearing protection system is offset from the center axis of the shaft thereby creating a different fluid boundary about the fallback bearing protection system.

20. The method of claim 16, wherein the fallback bearing protection system radially diverts solids away from the uppermost bearing of an electrical submersible pump.

* * * * *